US007886469B2

(12) United States Patent
Curry

(10) Patent No.: US 7,886,469 B2
(45) Date of Patent: Feb. 15, 2011

(54) FIREARM HAVING NONMETALLIC COMPONENTS AND AN EXTRACTOR YOKE LOCKUP

(75) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 12/760,927

(22) Filed: Apr. 15, 2010

(65) Prior Publication Data

US 2010/0192441 A1 Aug. 5, 2010

Related U.S. Application Data

(63) Continuation of application No. 12/648,902, filed on Dec. 29, 2009.

(60) Provisional application No. 61/141,715, filed on Dec. 31, 2008, provisional application No. 61/169,356, filed on Apr. 15, 2009, provisional application No. 61/169,359, filed on Apr. 15, 2009.

(51) Int. Cl.
*F41A 17/00* (2006.01)

(52) U.S. Cl. ..... 42/67; 42/59; 42/62; 42/65

(58) Field of Classification Search ..... 42/59, 42/62, 65, 67

See application file for complete search history.

(56) References Cited

U.S. PATENT DOCUMENTS 688,141 A * 12/1901 Wesson ..... 42/62
743,784 A * 11/1903 Wesson ..... 42/62
1,518,027 A * 12/1924 Vosmek ..... 42/62
1,630,404 A * 5/1927 Nicholson ..... 42/62
2,958,151 A * 11/1960 Sefried, II ..... 42/67
3,030,723 A * 4/1962 Ivy ..... 42/65
3,177,602 A * 4/1965 Geber ..... 42/62
3,387,399 A * 6/1968 McClenahan ..... 42/62
RE26,534 E * 3/1969 Lewis ..... 42/62
3,685,193 A * 8/1972 Sefried, II ..... 42/62
3,813,804 A * 6/1974 Ruger ..... 42/62
3,874,104 A * 4/1975 Sibley ..... 42/68
4,541,193 A * 9/1985 Flippin ..... 42/68
4,619,064 A * 10/1986 Stolz ..... 42/69.01
4,694,602 A * 9/1987 Pust ..... 42/59
4,908,969 A * 3/1990 Lechelle et al. ..... 42/62
4,918,850 A * 4/1990 Rick ..... 42/59
D335,911 S * 5/1993 Militello ..... D22/108
5,341,587 A * 8/1994 Phillips, Jr. ..... 42/68
6,266,908 B1 7/2001 Spencer et al.

(Continued)

*Primary Examiner*—Troy Chambers
(74) *Attorney, Agent, or Firm*—McCormick, Paulding & Huber LLP

(57) ABSTRACT

A polymeric revolver including a frame, a cylinder mounted in a rectangular aperture in the frame via a yoke, and a cylinder retaining mechanism is provided. The cylinder retaining mechanism includes multiple assemblies, which lock the yoke in the cylinder-closed position, including: (1) an extractor, a locking bolt and a locking bolt retainer that house an extractor rod spring and engage a ratchet hub driver, hub drive center pin and central pin plate that house a ratchet drive spring; (2) a star-shaped configuration of grooves and ridges on the extractor and the ratchet hub driver, respectively; (3) a rear taper of the locking bolt that engages a concave recess at the axial center of the rounded groove of the locking bolt recess; and (4) an annular ring that engages an inner wall of an annular opening in a breach face of the frame.

20 Claims, 12 Drawing Sheets

U.S. PATENT DOCUMENTS 6,330,761 B1 12/2001 Duval et al.
6,357,157 B1 * 3/2002 Constant et al. ..... 42/84
6,523,294 B2 2/2003 Curry et al.
6,574,898 B2 6/2003 Spencer et al.
6,634,128 B1 * 10/2003 Vastag ..... 42/59
7,059,075 B1 6/2006 Curry et al.
7,254,913 B2 8/2007 Dubois et al.
7,263,795 B1 9/2007 Curry
2009/0044436 A1 * 2/2009 Zajk ..... 42/59

* cited by examiner

FIREARM HAVING NONMETALLIC COMPONENTS AND AN EXTRACTOR YOKE LOCKUP

CROSS-REFERENCE TO RELATED APPLICATIONS

The present application is a continuation of non-provisional U.S. patent application Ser. No. 12/648,902, filed on Dec. 29, 2009, which claims the benefit of provisional U.S. Patent Application Ser. No. 61/141,715, filed on Dec. 31, 2008; and also claims the benefit of provisional U.S. Patent Application Ser. No. 61/169,356, filed on Apr. 15, 2009, and provisional U.S. Patent Application Ser. No. 61/169,359, filed on Apr. 15, 2009, which are hereby incorporated by reference. The present application is related to U.S. patent application Ser. No. 12/760,873, filed on Apr. 15, 2010 and is hereby incorporated by reference.

FIELD OF THE INVENTION

The present invention relates generally to firearms and, more particularly, to a revolver having nonmetallic components and an improved extractor yoke lockup.

BACKGROUND OF THE INVENTION

Known revolvers employ a rotatable cylinder mounted in a rectangular aperture of a frame of the revolver for selectively positioning one of a plurality of rounds of ammunition in opposition to the firing bore of the revolver. The cylinder is typically rotatably mounted on a yoke of the revolver for selectively moving the cylinder in or out of the rectangular aperture of the frame during a loading or unloading operation.

For example, a known revolver includes a frame, a barrel, an ejector rod assembly and a cylinder having a plurality of longitudinal bores which are adapted to selectively position, in sequence, rounds of ammunition in opposition to the firing bore of the barrel. A yoke stud is integrally mated to the frame and provides an axis of rotation to selectively pivot both the yoke and the cylinder between an open position and its closed position. A spring biased ball plunger is integrally mated to the yoke and in communication with a ball cavity formed in the body of the frame for retaining the yoke and the cylinder in the closed position.

While successful to a certain degree, the interaction between the spring biased ball plunger and the ball cavity may experience sporadic, operational complications during and immediately following the discharge of a round of ammunition. When a round is discharged, the forces that propel the round down the length of the barrel exert a corresponding force in the opposite direction, that is, towards the rear, handgrip portion of the revolver. Although the effect of this opposite force is marginal on the interconnected elements of the revolver, the manufacturing tolerances inherent in the revolver permit a minute amount of structural translation to occur as a result of this incident and opposite discharge force.

The effect of the structural translation of certain elements in the revolver, as a result of the discharge of a round of ammunition and the associated manufacturing tolerances of the revolver, may cause the cylinder and the yoke assembly, to move slightly rearwardly, towards the handgrip portion of the revolver. The rearward movement of the yoke may cause the spring biased ball plunger to disengage from the ball cavity, thus facilitating the unintended pivoting of the cylinder from the closed position to the open position. The possibility of the spring biased ball plunger disengaging from the ball cavity may increase in proportion to the age of the revolver, owing to the increasing age and reduced resilience of the biasing spring, or the like, which serves to bias the ball plunger into contact with the restraining ball cavity.

There is, therefore, a need for a retaining mechanism to retain the cylinder within the rectangular aperture, especially subsequent to firing.

There is also a concern that firearms, and, in particular, revolvers, be designed so that the expended ammunition cartridge can be easily removed from the cylinder upon being discharged. Known revolvers employ an extractor, which disrupts the connection of the round of ammunition to the cylinder, in order to rapidly expel expended ammunition from the chamber of the cylinder. Said extractors are generally designed to avoid having any impact on the retention or release of the cylinder from the rectangular aperture of the frame. There is, therefore, a need for an improved extractor that works in conjunction with the retaining mechanism to promote retention of the cylinder in the rectangular aperture, especially subsequent to firing.

There is also a concern that, once the expended ammunition cartridges have been removed and new ammunition cartridges have been inserted into the cylinder, the retaining mechanism be designed so that the cylinder and yoke assembly can be easily pivoted from the open position to the closed position. There is, therefore, a need for an improved closing mechanism.

SUMMARY OF THE INVENTION

In view of the foregoing, it is an object of the present invention to provide a revolver with an improved yoke lockup mechanism that prevents the revolver from coming out of battery during operation.

It is another object of the present invention to provide a revolver with an improved extractor that works in conjunction with the yoke lockup mechanism to prevent the revolver from coming out of battery during operation.

It is another object of the present invention to provide a revolver with an improved yoke assembly that facilitates the pivoting of the cylinder and yoke assembly from the open position to the closed position.

According to an embodiment of the present invention, a firearm having a cylinder retaining mechanism is provided. The firearm includes a frame defining an aperture having a breach face and a locking bolt recess disposed on a side of the aperture opposite from the breach face, wherein the locking bolt recess comprises a narrow section with a concave recess; a cylinder mounted in the aperture and defining a bore; and a locking bolt mounted in the bore and fitted to be received in the concave recess; wherein the cylinder is retained in the aperture when the locking bolt is received in the concave recess.

According to another embodiment of the present invention, a firearm having a cylinder retaining mechanism is provided. The firearm includes a frame defining an aperture and an annular opening in a breach face thereof; a cylinder pivotally mounted in the aperture and defining a bore; and an extractor mounted in the bore and having an annular ring fitted to be inserted in the annular opening; wherein the cylinder is retained in the aperture when the annular ring is inserted in the annular opening.

According to another embodiment of the present invention, a firearm having a cylinder rotating mechanism is provided. The firearm includes: a frame defining an aperture; a cylinder rotatably mounted in the aperture and having a bore; an extractor mounted coaxially in the bore, wherein the extractor is rotationally fixed to the cylinder; a ratchet hub driver mounted coaxially with and engaged to the extractor and having annular lobed ridges; a hand having an end that abuts and reciprocally engages the annular lobed ridges of the ratchet hub driver; and a trigger connected to a distal end of the hand; whereby actuation of the trigger causes the hand to engage the annular lobed ridges of the ratchet hub driver, which rotates the ratchet hub driver, the extractor and the cylinder.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
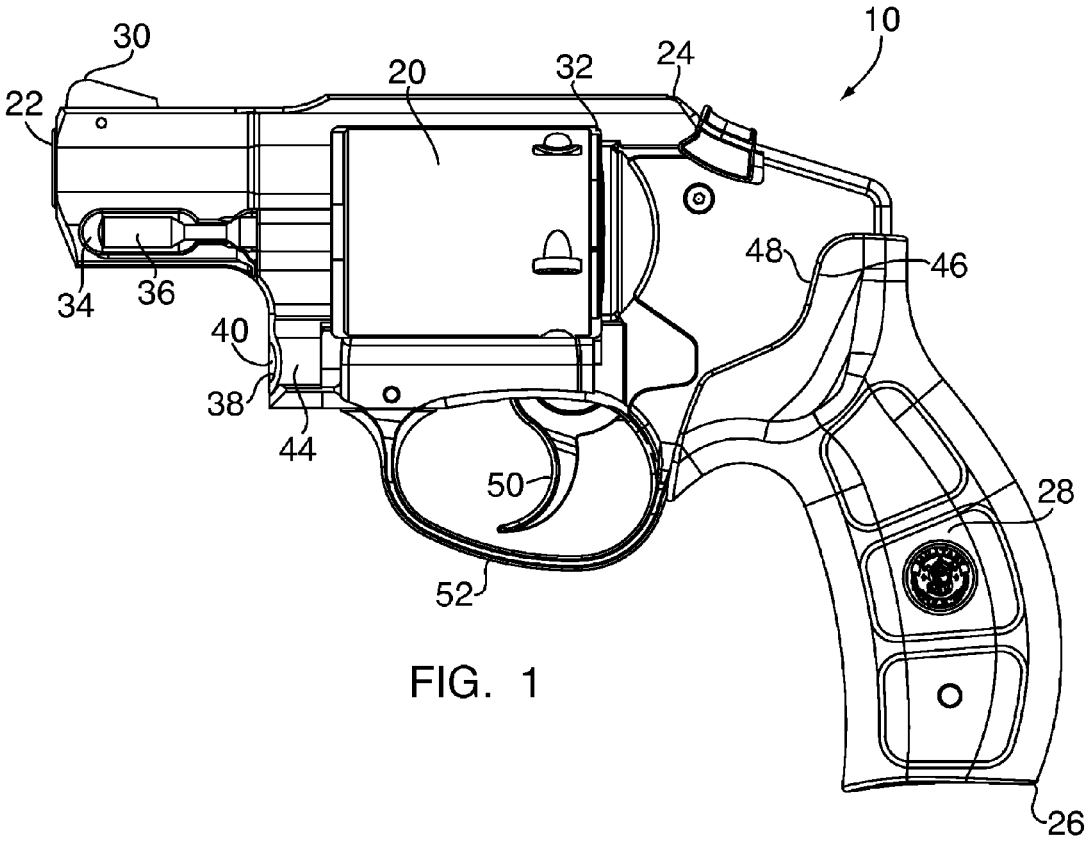
FIG. 1 is a side view of the revolver according to a first embodiment of the present invention.
Figure 2:
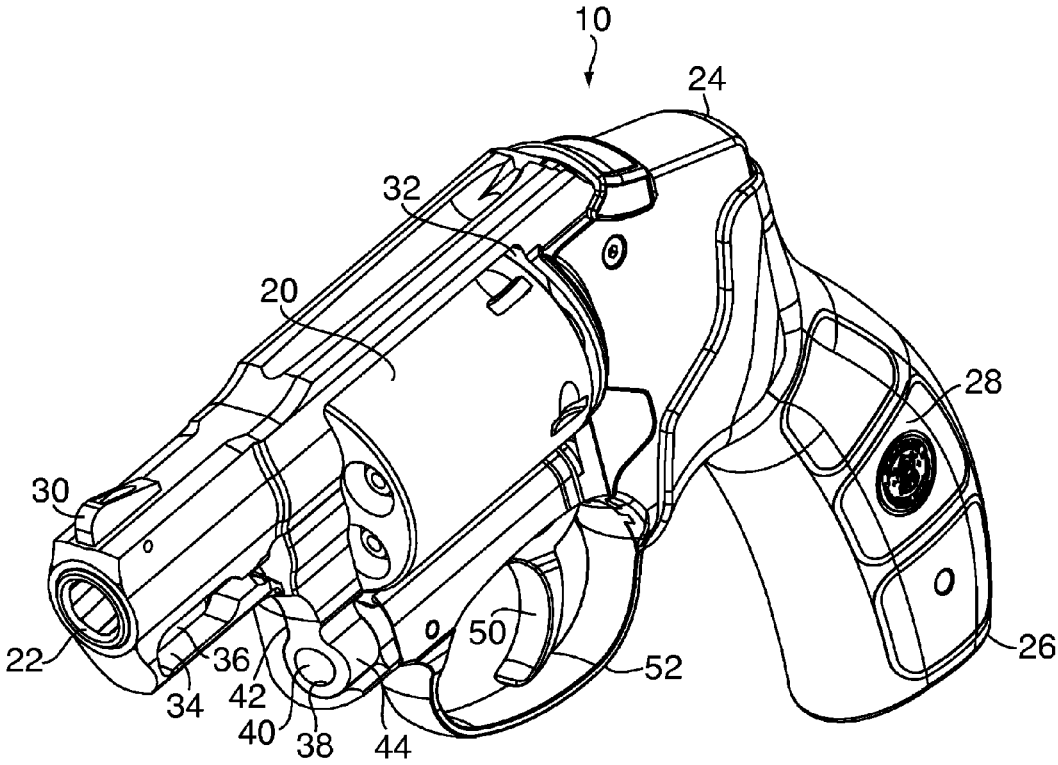
FIG. 2 is a perspective view of the revolver according to the embodiment of FIG. 1.

Referring to FIGS. 1 and 2, one exemplary embodiment of a firearm incorporating the present invention is shown generally at 10 and is hereinafter referred to as "firearm 10." The firearm 10 is preferably a revolver (as described in U.S. Pat. Nos. 6,330,761, 6,523,294, 7,059,075, 7,254,913 and 7,263,795 and provisional U.S. Patent Application No. 61/141,715, which are incorporated herein by reference) that includes a frame, a cylinder 20, a barrel 22, and a firing mechanism.

The frame is generally comprised of two main parts, an upper frame portion 24 and a lower frame portion 26. The lower frame portion 26 contains a back strap, a main spring housing and a grip 28, as well as space for a portion of the firing mechanism.

The upper frame portion 24 contains the barrel 22 and the sight 30, as well as space for another portion of the firing mechanism. The upper frame portion 24 also contains: a rectangular aperture 32 for mounting the cylinder 20, a locking bolt recess 34 for slidably receiving a locking bolt 36, a yoke stud recess 38 for securing a yoke stud 40 and a yoke carve out 42 for pivotally mounting the yoke 44 on the yoke stud 40.

A forward end 46 of the lower frame portion 26 is shaped so as to accept a corresponding rearward end 48 of the upper frame portion 24. These upper and lower frame portions 24, 26 are joined together via pins to create a structurally rigid frame.

The frame portions 24, 26 are comprised of metal stampings or inserts having a polymer over-molding on top of the inserts. However, other metallic and nonmetallic materials may be used without departing from the scope of the present invention. While many prior art revolvers need to be bent to ensure that the barrel, the cylinder, the firing mechanism and the locking mechanism all come into registration within prescribed tolerances so that the revolver operates properly, such bending is not required with the polymer frame firearm 10 of the present invention.

The frame also includes a trigger 50 that is pivotally attached to the upper frame portion 24 and a separate trigger guard 52 that is releasably attached to both the upper and lower frame portions 24, 26.

The cylinder 20 is rotatably mounted on a cylindrical portion (see FIGS. 3 and 4) of the yoke 44. In other words, the cylinder 20 may be pivoted into and out of the rectangular aperture 32 in the upper frame portion 24 along the pivot path defined by the yoke 44 and/or rotated relative to the yoke 44.

Figure 3:
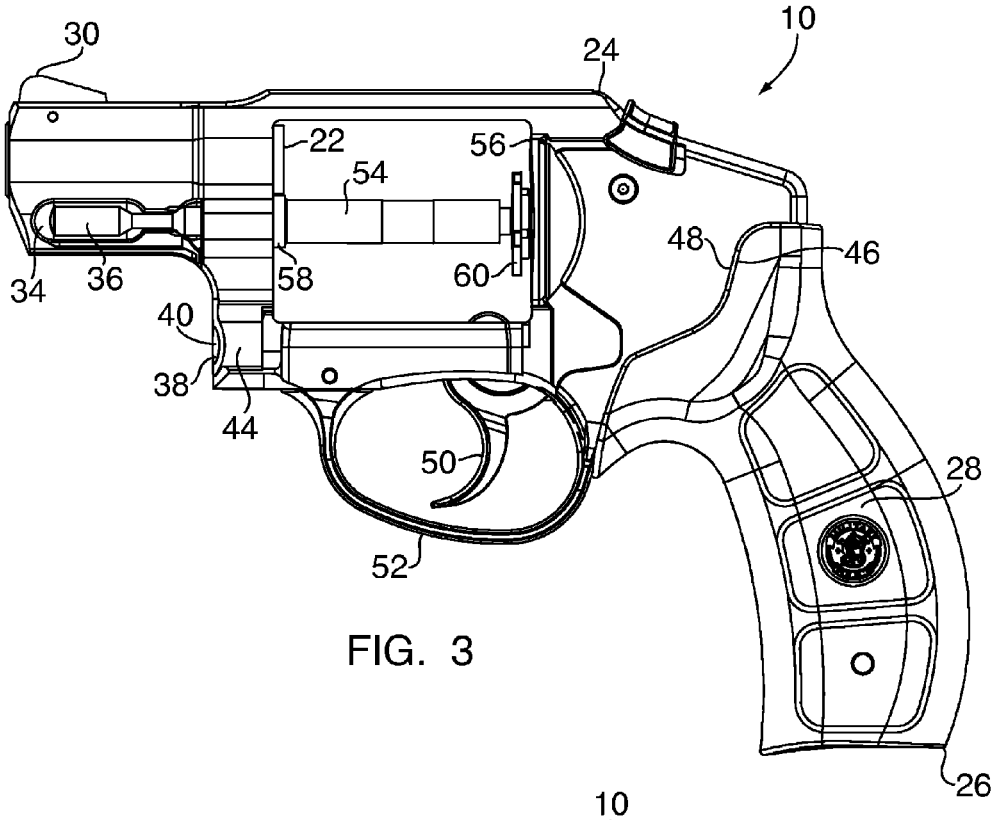
FIG. 3 is a side view of the revolver with the cylinder removed according to the embodiment of FIG. 1.
Figure 4:
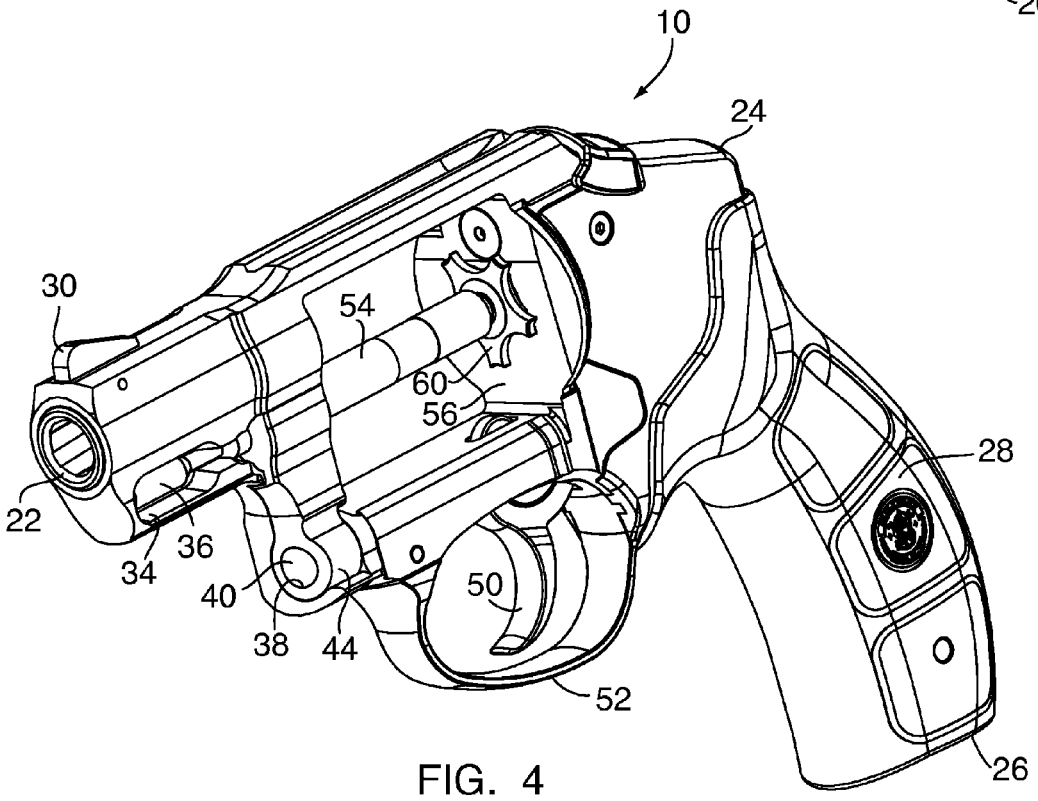
FIG. 4 is a perspective view of the revolver according to the embodiment of FIG. 3.

Referring now to FIGS. 3 and 4, the firearm 10 is shown with the cylinder removed to illustrate the rectangular aperture 32. Typically, as is shown in FIGS. 1 and 2, the cylinder 20 of an assembled firearm 10 would be rotatably mounted axially on a cylindrical portion 54 of the yoke 44 with a front face of the cylinder 20 substantially abutting the rear-facing inner surface of the frame and the rear face of the cylinder substantially abutting a front-facing breach surface 56 of the frame. However, with the cylinder 20 removed, it should be appreciated that the cylinder 20 actually abuts the rear surface of the barrel 22 and an enlarged portion 58 of the yoke 44 on the front side of the firearm 10, and an extractor 60 on rear side of the firearm 10. In particular, the front face of the cylinder 20 presses flush against the rear opening of the barrel 22 such that the barrel-cylinder gap is minimized.

Figure 5:
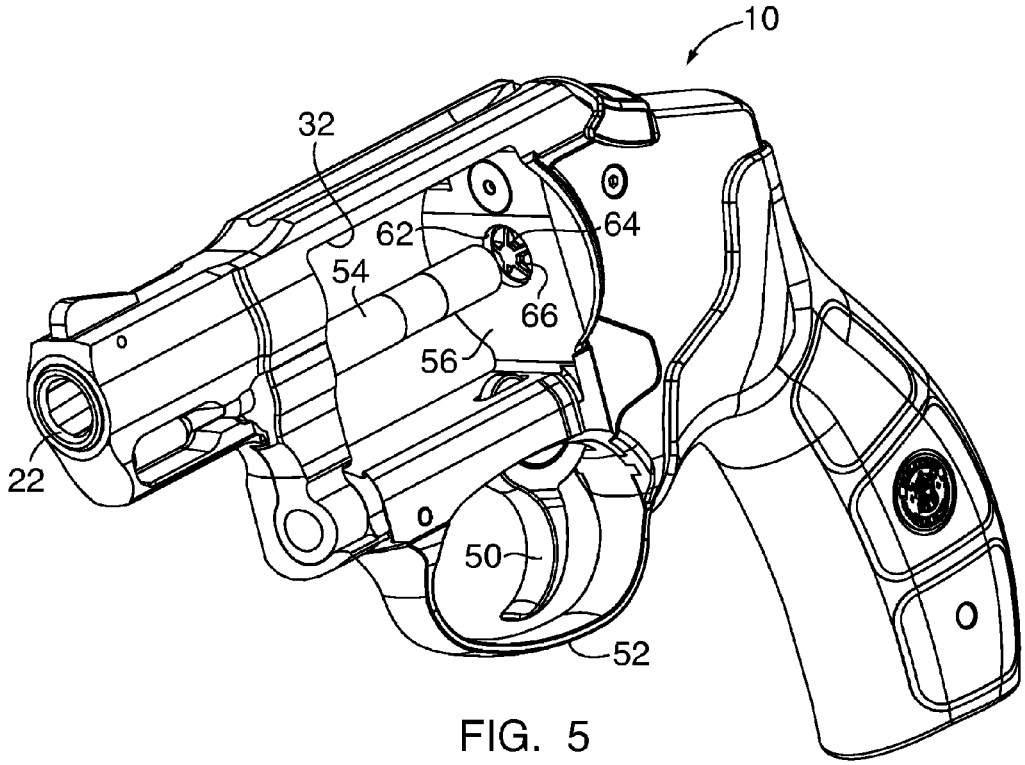
FIG. 5 is a perspective view of the revolver with the cylinder and the extractor removed according to the embodiment of FIG. 1.

Referring now to FIG. 5, the firearm 10 is shown with the cylinder 20 and the extractor 60 removed. As shown, an annular opening 62 is provided in the breach surface 56 of the rectangular aperture 32, coaxial with the cylindrical portion 54. Slidably and rotatably mounted in the annular opening 62 is a ratchet hub driver 64 having a star-shaped configuration of ridges 66 on its front facing surface.

Figure 6:
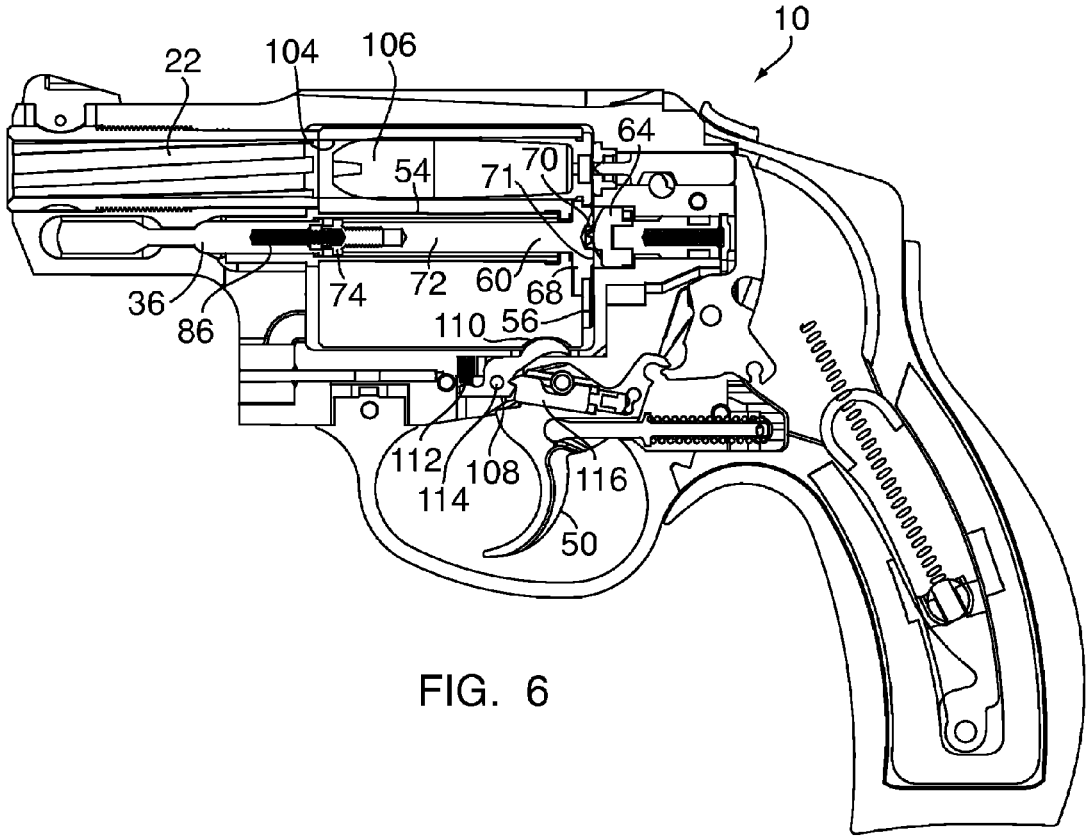
FIG. 6 is a side view of a cross section of the revolver according to the embodiment of FIG. 1.
Figure 7:
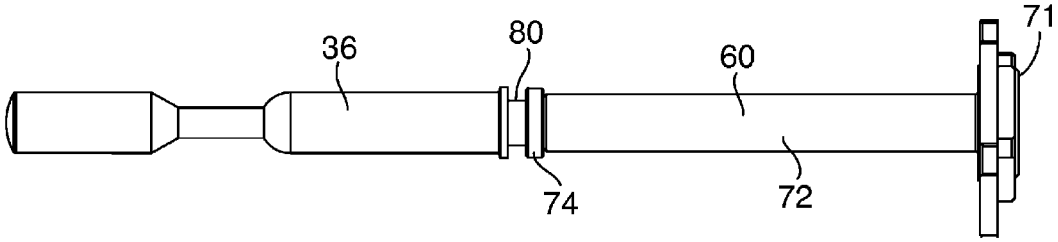
FIG. 7 is a side view of the locking bolt and extractor assembly according to the embodiment of FIG. 1.
Figure 8:
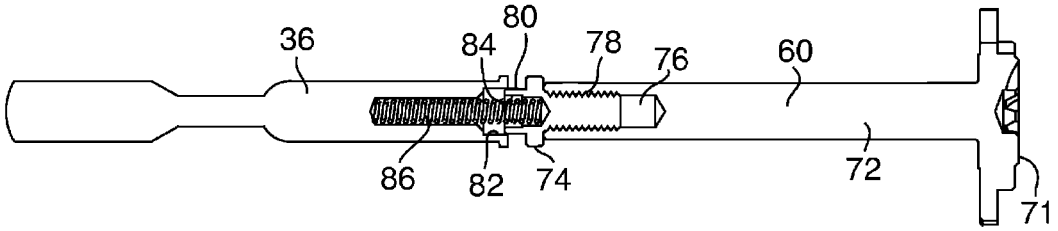
FIG. 8 is a side view of the cross section of the locking bolt and extractor assembly according to the embodiment of FIG. 7.

Referring now to FIG. 6, a side view of a cross section of a fully assembled firearm 10 is shown. The rearward face of the body portion 68 of the extractor 60 rests flush against the breach surface 56 and engages the ratchet hub driver 64 with a complimentary star-shaped configuration of grooves 70. The rearward face of the extractor 60 also has an annular ring 71 that is fitted to the annular opening 62 and, in the cylinder-closed position, is inserted therein.

Figure 9:
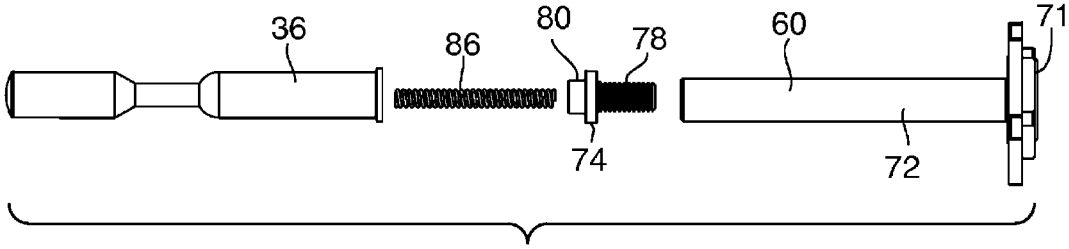
FIG. 9 is a side exploded view of the locking bolt and extractor assembly according to the embodiment of FIG. 7.
Figure 10:
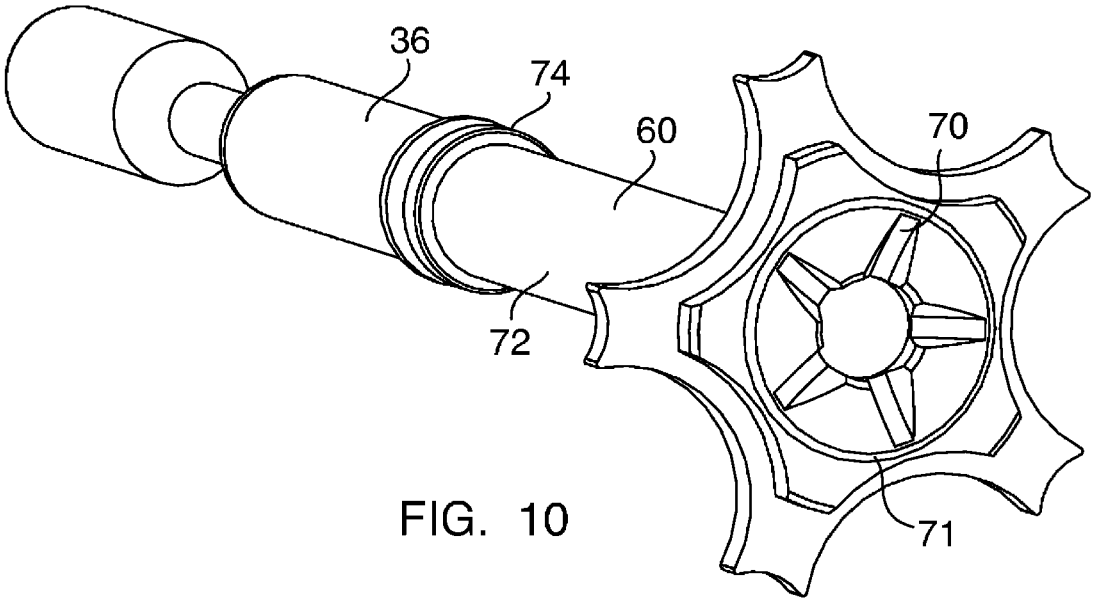
FIG. 10 is a perspective view of the locking bolt and extractor assembly according to the embodiment of FIG. 7.
Figure 11:
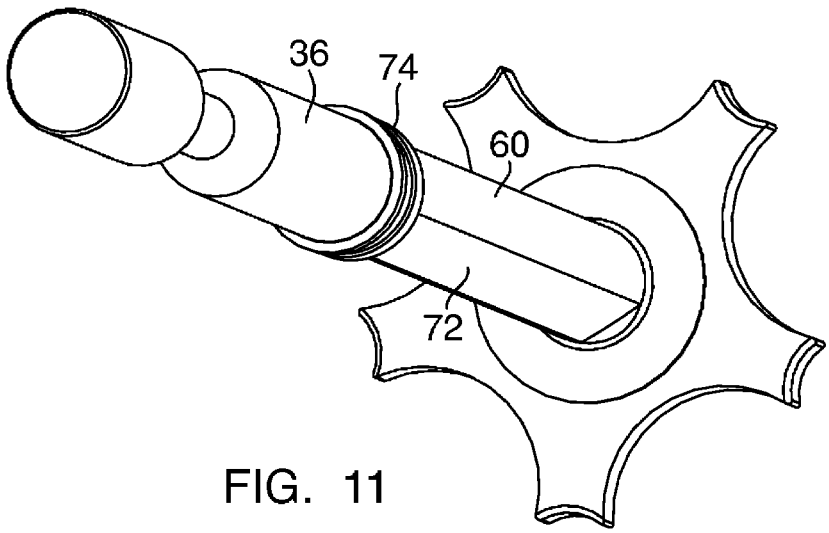
FIG. 11 is another perspective view of the cylinder assembly according to the embodiment of FIG. 7.

Referring to FIGS. 7-11, the extractor 60 and the locking bolt 36 assembly is shown in a number of views including a side cross sectional view (FIG. 8) and a side exploded view (FIG. 9). A frontward extractor shaft portion 72 of the extractor 60 connects to the locking bolt 36 via an extractor spring retainer 74. The extractor spring retainer 74 is mounted in a cylindrical recess 76 in the end of the extractor shaft portion 72 by means of a complimentary threaded screw and threaded groove engagement 78. The extractor spring retainer 74 includes a cylindrical extension 80, which is fitted to an opposing recess 82 in the locking bolt 36, and a coaxial recess 84 in the cylindrical extension 80, which receives the rearward end of an extractor rod spring 86. The opposing recess 82 in the locking bolt 36 receives the frontward end of the extractor rod spring 86.

When compressed (e.g., in the cylinder-closed position), the extractor rod spring 86 presses the locking bolt 36 against the locking bolt recess 34 and the rear face of the body portion 68 of the extractor 60 against the breach face 56.

Figure 12:
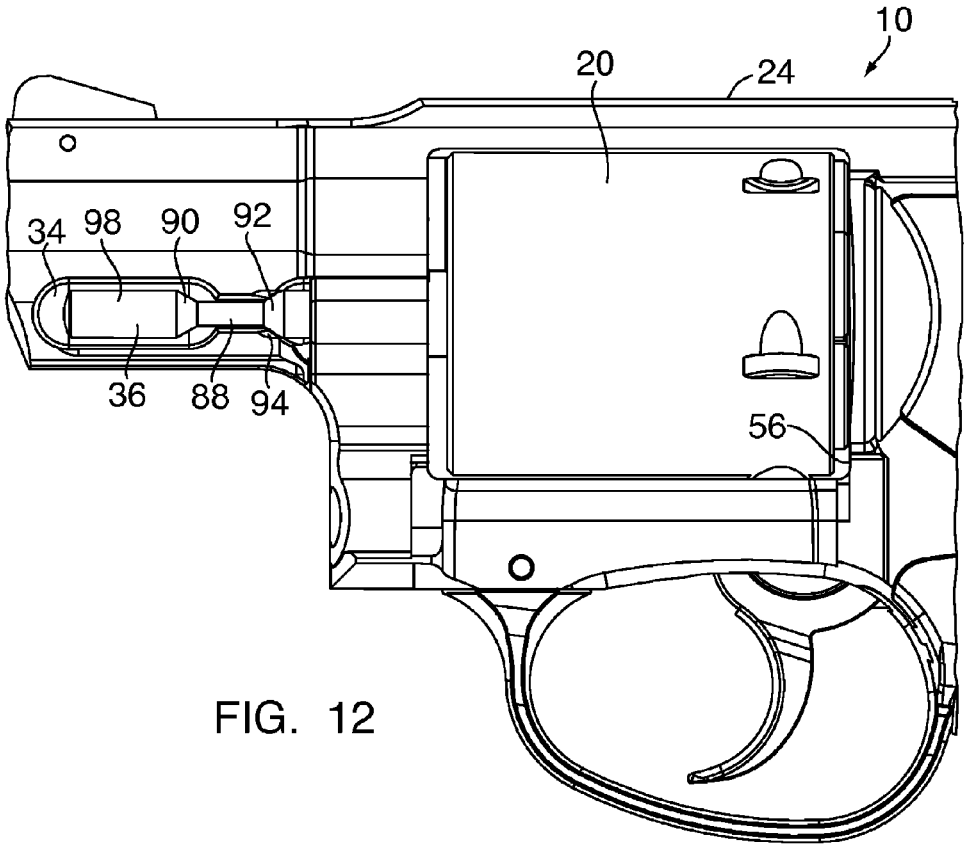
FIG. 12 is side view of the front portion of the revolver according to the embodiment of FIG. 1.
Figure 13:
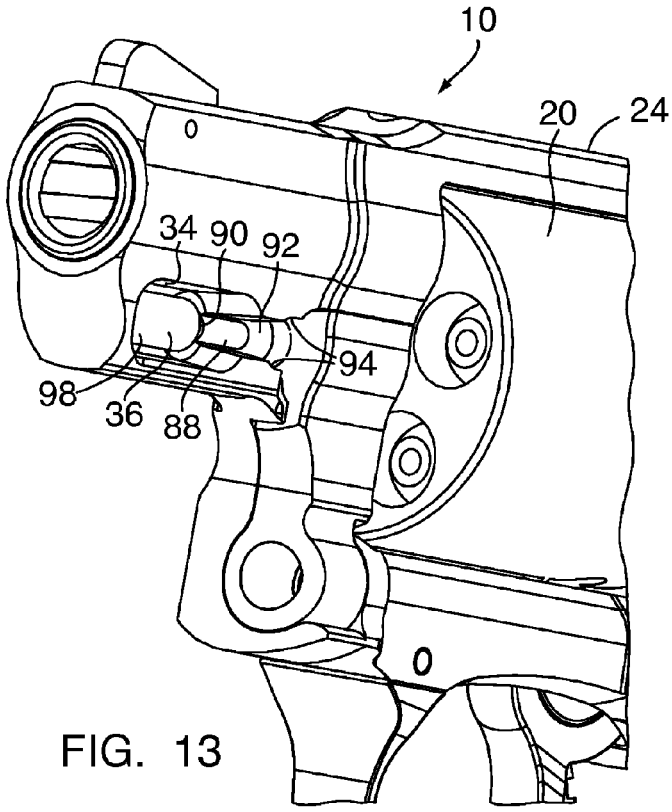
FIG. 13 is a perspective view of the revolver according to the embodiment of FIG. 12.
Figure 14:
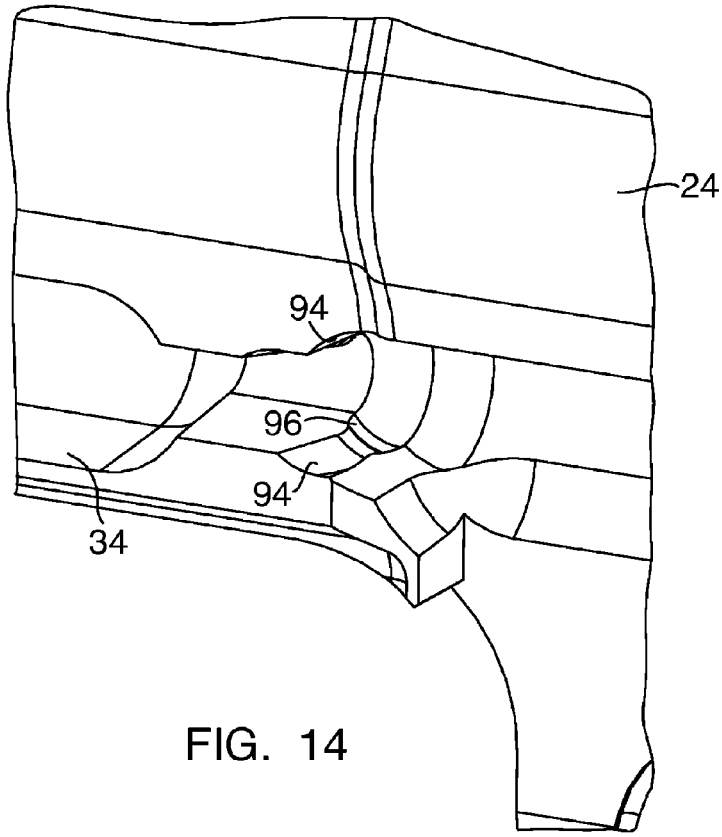
FIG. 14 is a perspective view of the locking bolt recess of the revolver according to the embodiment of FIG. 1.

In particular, referring now to FIGS. 12-14, the locking bolt 36 has a narrow cylindrical rod portion 88 with a conical front taper 90 on the frontward side and a conical rear taper 92 on the rearward side. When the extractor rod spring 86 is compressed, the rear taper 92 engages rounded grooves 94 positioned on the upper and lower walls of the locking bolt recess 34. The laterally outward portions of the rounded grooves 94 are angled slightly rearwards from a horizontal lateral axis such that the distance between the rearward surface of the rounded grooves 94 and the breach face 56 decreases as the rounded grooves 94 approaches the center of the firearm 10. However, at a position substantially adjacent to the resting position of the locking bolt 36 in the cylinder-closed position (i.e., near the center of the firearm), the rounded grooves 94 angle slightly frontward to culminate in a concave recess 96 that engages the rear taper 92. Thus, when the firearm is in the cylinder-closed position, the locking bolt 36 and locking bolt recess 34 engagement will retain the cylinder 20 in the cylinder-closed position until a sufficient amount of lateral pressure is applied to the cylinder 20 to displace the rear taper 92 across the rearward threshold of the concave recess 96.

The end of the locking bolt 36 includes a knob 98. When the firearm is in the cylinder-closed position, a knob 98 is suspended away from the walls of the locking bolt recess 34. In such an arrangement, it is possible to gain access to the knob 98 if desired (e.g., to actuate the locking bolt 36 rearward to overcome the rear threshold of the concave recess 96 or to apply a lateral force to release the cylinder 20 from the cylinder-closed position). However, without a corresponding actuation of the cylinder release mechanism (as discussed below), it is difficult to release the cylinder 20 from the upper portion of the frame 24.

Referring to FIG. 6, the extractor spring retainer 74, the extractor rod spring 86, part of the extractor shaft portion 72 and part of the locking bolt 36 are removably and rotatably mounted inside the cylindrical portion 54. However, referring now to FIG. 15, a flattened surface 100 of the arcuate extractor shaft portion 72 engages a complimentary arcuate cylinder bore 102 positioned rearward on the cylinder 20, proximate to the body portion 68 when the cylinder 20 and extractor 60 are assembled. The coupling of arcuate extractor shaft portion 72 and arcuate cylinder bore 102 creates a rotationally fixed engagement between the cylinder 20 and the extractor 60.

As shown in FIG. 6, the cylinder 20 includes chambers 104 that are configured to receive and align ammunition cartridges 106 with the barrel 22. When the ammunition cartridge 106 is aligned with the barrel 22, the cylinder stop 108 is pressed into an outer recess 110 in the cylinder 20 by the compressive force of a cylinder stop spring 112 placed on the distal end of a central pivot 114 of the cylinder stop 108. However, when the trigger 50 is actuated rearward (i.e., to discharge the chambered ammunition cartridge 106), a reset plunger 116 that is attached to the trigger 50 actuates the cylinder stop 108 downward causing a cylinder stop 108 to disengage the outer recess 110 thereby allowing the cylinder 20 to rotate.

Figure 15:
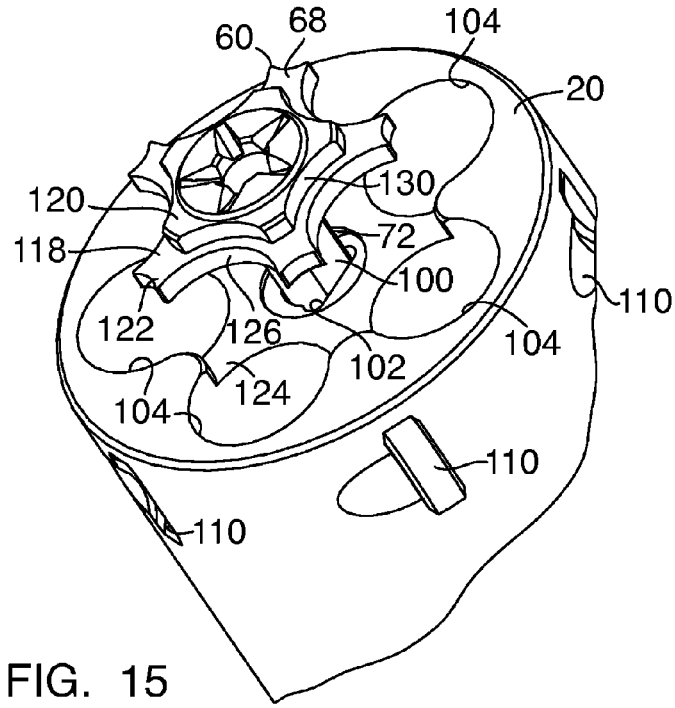
FIG. 15 is a perspective view of the extractor and the cylinder, assembled but displaced from one another, of the revolver according to the embodiment of FIG. 1.

Referring now to FIG. 15, the extractor 60 is shown with the cylinder 20 such that the extractor 60 and cylinder 20 are slightly displaced from the assembled configuration. The body portion 68 of the extractor 60 has two layers: a frontward layer 118 and a rearward layer 120.

Referring now to FIGS. 15-19, the frontward layer 118 (i.e., the layer closest to the extractor shaft portion 72) has a number of prongs 122 fitted to an extractor recess 124 in the rearward face of the cylinder 20 and includes notches 126 for receiving a section of the shaft 128 of ammunition cartridges 106. In the assembled position, the frontward face of the frontward layer 118 lies flush against the rearward face of the extractor recess 124 and the rearward face of the frontward layer 118 lies flush against the rearward face of the cylinder 20.

The rearward layer 120 has a similar geometry to the frontward layer 118 but includes larger notches 130 for receiving the rearmost ridge 132 of ammunition cartridges 106, which is larger than the cylindrical shaft thereof. In the assembled position, the rearward face of the rearward layer 120 lies flush with the inserted ammunition cartridges 106, both of which lie flush with the breach surface in the cylinder-closed position.

Figure 16:
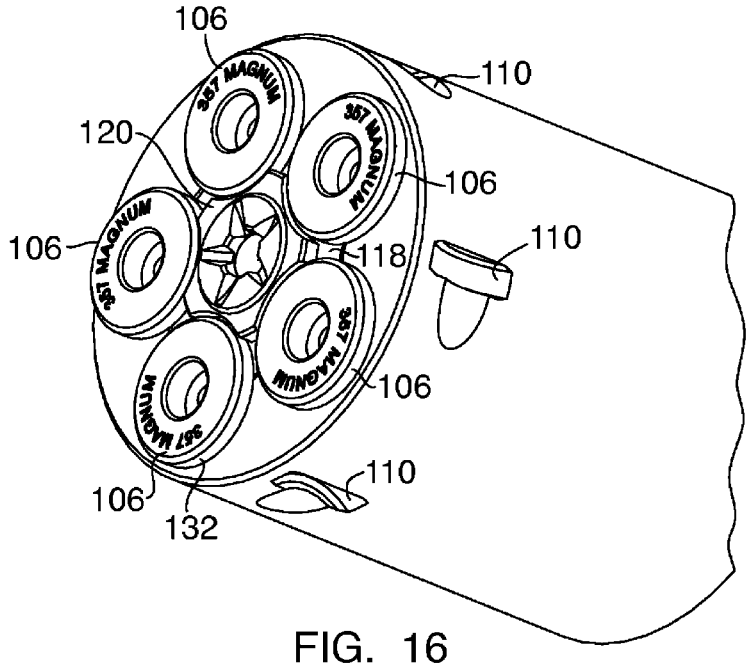
FIG. 16 is a perspective view of the extractor and the cylinder, assembled and having ammunition cartridges loaded into the chambers, of the revolver according to the embodiment of FIG. 1.
Figure 17:
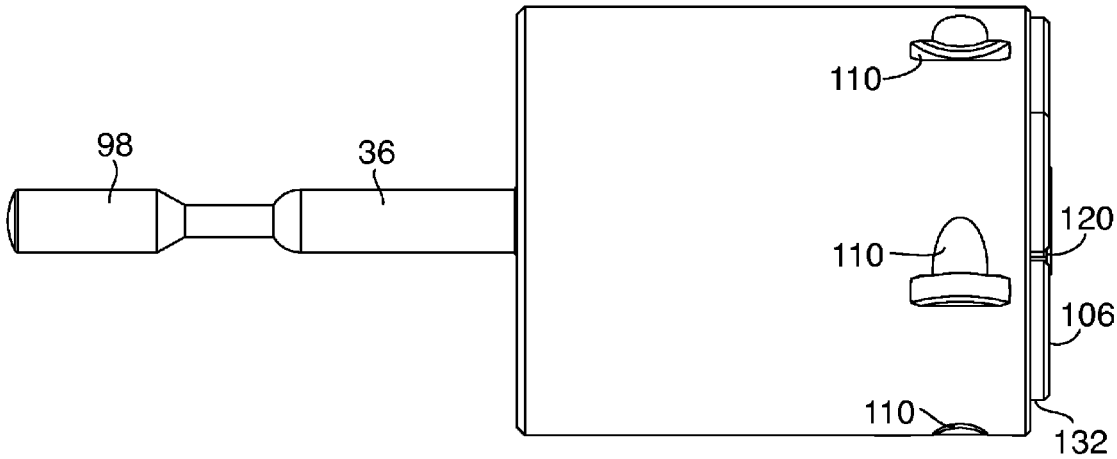
FIG. 17 is a side view of the locking bolt, the extractor and the cylinder, assembled and having ammunition cartridges loaded into the chambers, of the revolver according to the embodiment of FIG. 1.
Figure 18:
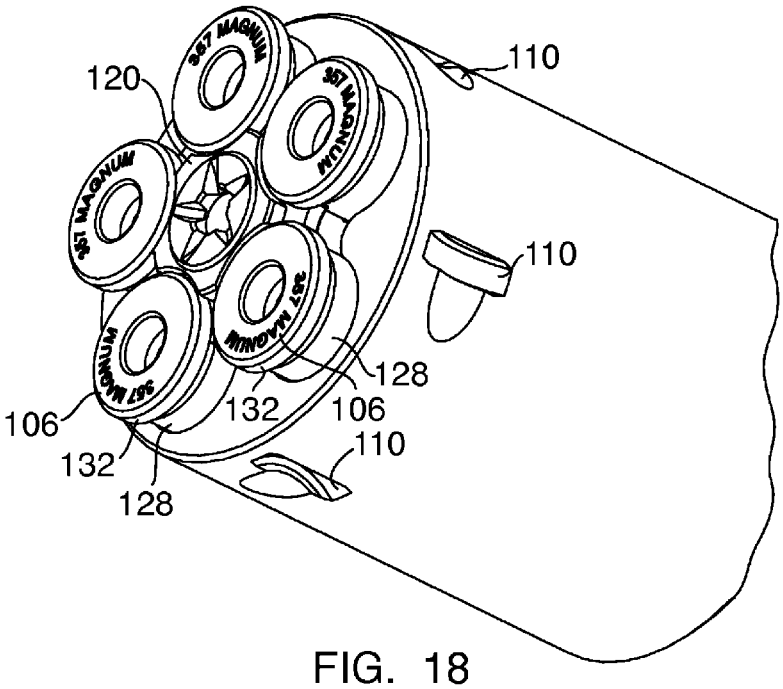
FIG. 18 is a perspective view of the extractor and the cylinder, assembled, with the extractor in a rearward actuated position and having ammunition cartridges loaded into the chambers, of the revolver according to the embodiment of FIG. 1.
Figure 19:
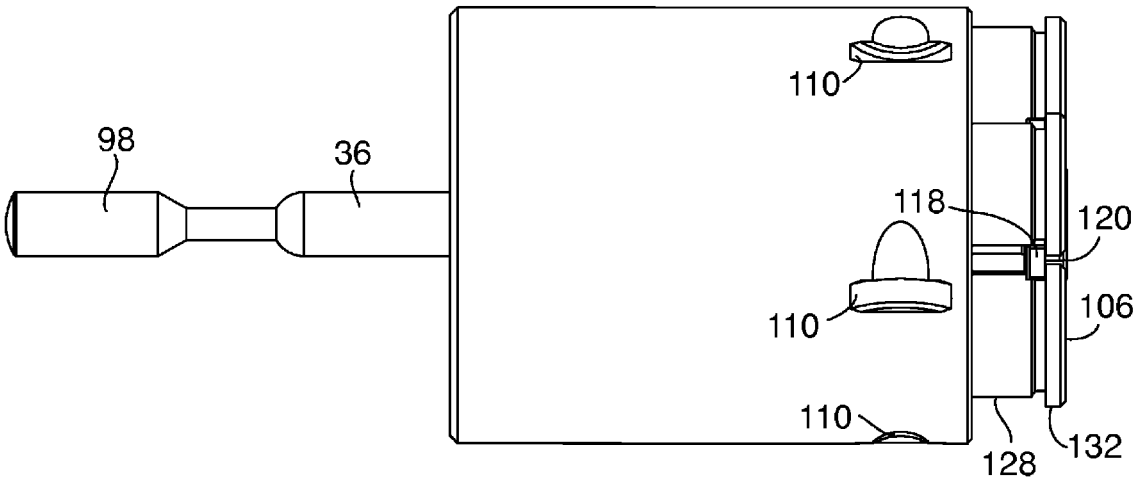
FIG. 19 is side view of the locking bolt, the extractor and the cylinder, assembled, with the extractor in a rearward actuated position and having ammunition cartridges loaded into the chambers, according to the embodiment of FIG. 18.

Referring now to FIGS. 16-19, according to an embodiment of the present invention, the cylinder 20, the extractor 60 and the locking bolt 36 assembly for facilitating ejection of the ammunition cartridges 106 is provided. As shown in FIGS. 16-17, the extractor 60 and the cylinder 20 are assembled with ammunition cartridges 106 loaded in the chambers 104. To remove the ammunition cartridges 106 while the firearm is in the cylinder-open position, the knob 98 is actuated rearward. As shown in FIGS. 18-19, the rearward actuation of the knob 98 causes a rearward actuation of the extractor 60 and, in particular, the frontward layer 118. As the frontward layer 118 moves rearward, the frontward layer 118 presses against the rearmost ridge 132 of the ammunition cartridges 106 and drives the ammunition cartridge 106 rearward in the chambers 104, which dislodges the ammunition cartridges 106 slightly. The dislodgment is sufficient to facilitate the removal of an entire ammunition cartridge 106 from a chamber 104, for example, by rotating the assembly so that the knob 98 points upward and the body portion 68 is positioned downward.

Figure 20:
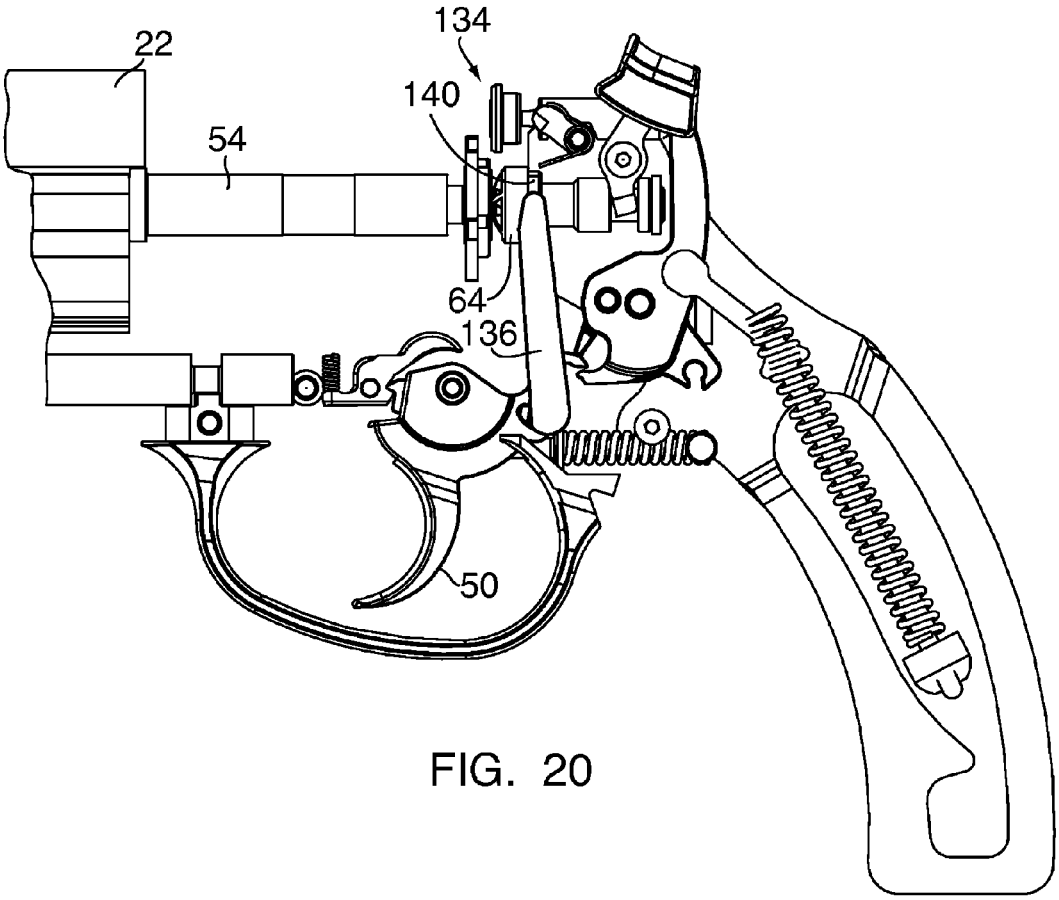
FIG. 20 is side view of the firing mechanism, the cylinder retaining mechanism and the cylinder releasing mechanism of the revolver according to the embodiment of FIG. 1.
Figure 21:
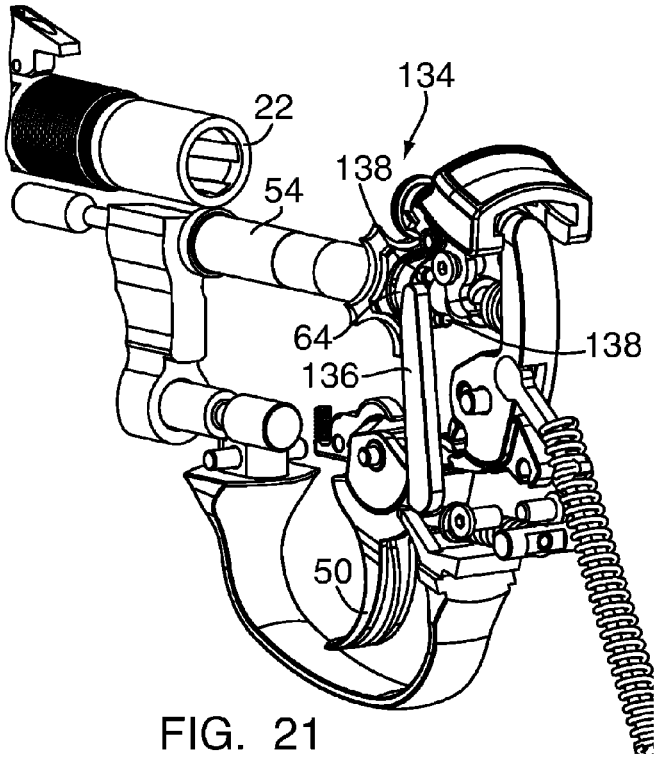
FIG. 21 is perspective view of the firing mechanism, the cylinder retaining mechanism and the cylinder releasing mechanism according to the embodiment of FIG. 20.

Referring now to FIGS. 20 and 21, a drive mechanism of the firearm is shown at 134. The drive mechanism 134 functions to rotate the cylinder 20 about the cylindrical portion 54 of the yoke 44 upon an actuation of the trigger 50 in order to place the next ammunition cartridge 106 into alignment with the barrel 22. In addition to arming and releasing the firing mechanism as described in provisional U.S. Pat. No. 6,141,715, which is incorporated herein by reference, the actuation of the trigger 50 simultaneously causes an upward movement of a hand 136, which is pivotally mounted to the rear of the trigger 50. The hand 136, in turn, rotates the ratchet hub driver 64 by engaging and actuating annular-lobed ridges 138 provided at intervals around the circumference of the rear of the ratchet hub driver 64, with uniform radius cylindrical surfaces 140 positioned between each annular-lobed ridge 138. Each annular-lobed ridge 138 is a substantially semicircular cylindrical body. However, the annular-lobed ridges 138 can be made up of cylindrical bodies having in excess of 180 degrees of circumferential surface. In other words, the axial center of each annular-lobed ridge 138 can be positioned proximate to and even outside of the circumference of the uniform radius cylindrical surface 140 between each annular-lobed ridge 138. There are as many annular-lobed ridges 138 as there are chambers 104 in the cylinder, whereby each actuation of the trigger 50 corresponds to the amount of rotation required to align the next chamber 104 with the barrel 22.

Figure 22:
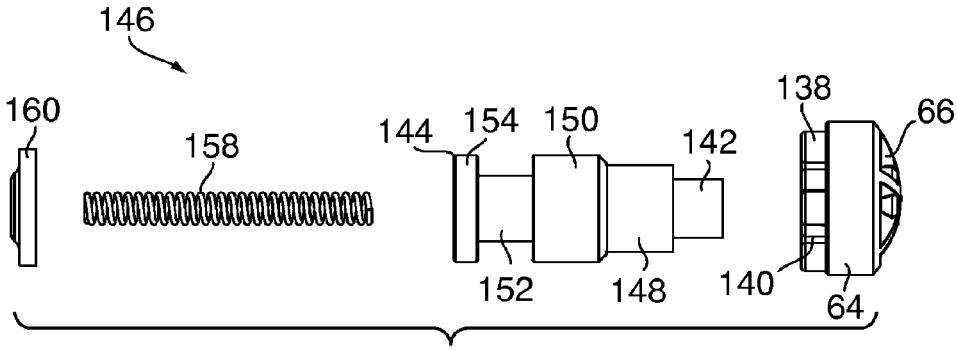
FIG. 22 is a side exploded view of the ratchet hub driver, the hub drive center pin, the ratchet drive spring and the center pin plate assembly of the revolver according to the embodiment of FIG. 1.
Figure 23:
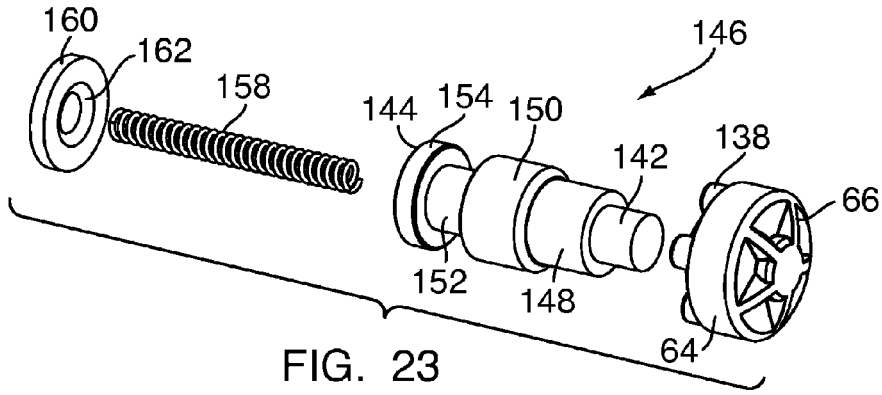
FIG. 23 is a perspective exploded view of the ratchet hub driver, the hub drive center pin, the ratchet drive spring and the center pin plate assembly according to the embodiment of FIG. 22.
Figure 24:
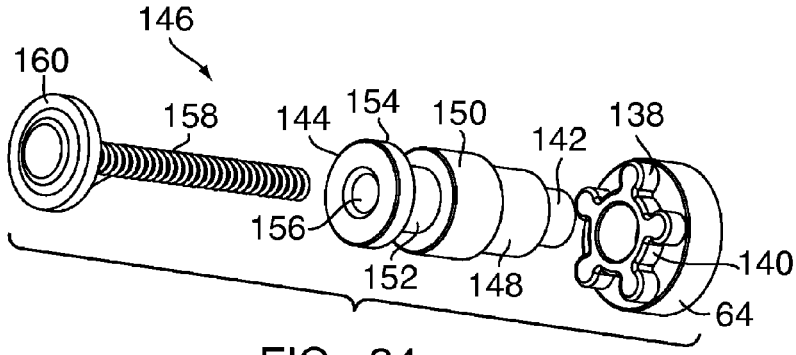
FIG. 24 is another perspective exploded view of the ratchet hub driver, the hub drive center pin, the ratchet drive spring and the center pin plate assembly according to the embodiment FIG. 22.

The ratchet hub driver 64 is mounted to a front cylindrical portion 142 of a hub drive center pin 144 as shown in FIG. 6. Referring now to FIGS. 22-24, the hub drive assembly is shown exploded at 146.

To the rear of the front cylindrical portion 142, the hub drive center pin 144 also includes an intermediate cylindrical portion 148, an enlarged cylindrical portion 150, a narrow cylindrical portion 152, and an enlarged nub 154, respectively.

The hub drive center pin 144 is a substantially hollow annular member that is rotatably mounted to the frame. For instance, a pin recess 156 is provided axially through substantially the entirety of the hub drive center pin 144 with the mouth of the pin recess 156 being located on the rear face of the enlarged nub 154. Inside the pin recess 156, a ratchet drive spring 158 is housed, which, when compressed, exerts a resistive force on the hub drive center pin 144 that translates to the ratchet hub driver 64 causing the ratchet hub driver 64 to protrude from the annular opening 62 across the breach face 56 and, if the cylinder 20 is in the cylinder-closed position, into engagement with the extractor 60.

A center pin plate 160 abuts the rear annular face of the hub drive center pin 144. The center pin plate 160 is a substantially flat disk mounted in the frame at the rear of the annular opening 62 and provides an opposing surface against which the ratchet drive spring 158 is compressed. In particular, a central indentation 162 of the center pin plate 160 receives the rearward end of the ratchet drive spring 158.

Also, as discussed above and as shown in greater detail in FIGS. 22-24, the front face of the ratchet hub drive 64 includes the configuration of star-shaped ridges 66 for engaging the corresponding grooves 70 of the body portion 68 of the extractor 60 and the rear face of the ratchet hub drive 64 includes annular lobed ridges 138 and uniform radius cylindrical sections 140.

Figure 25:
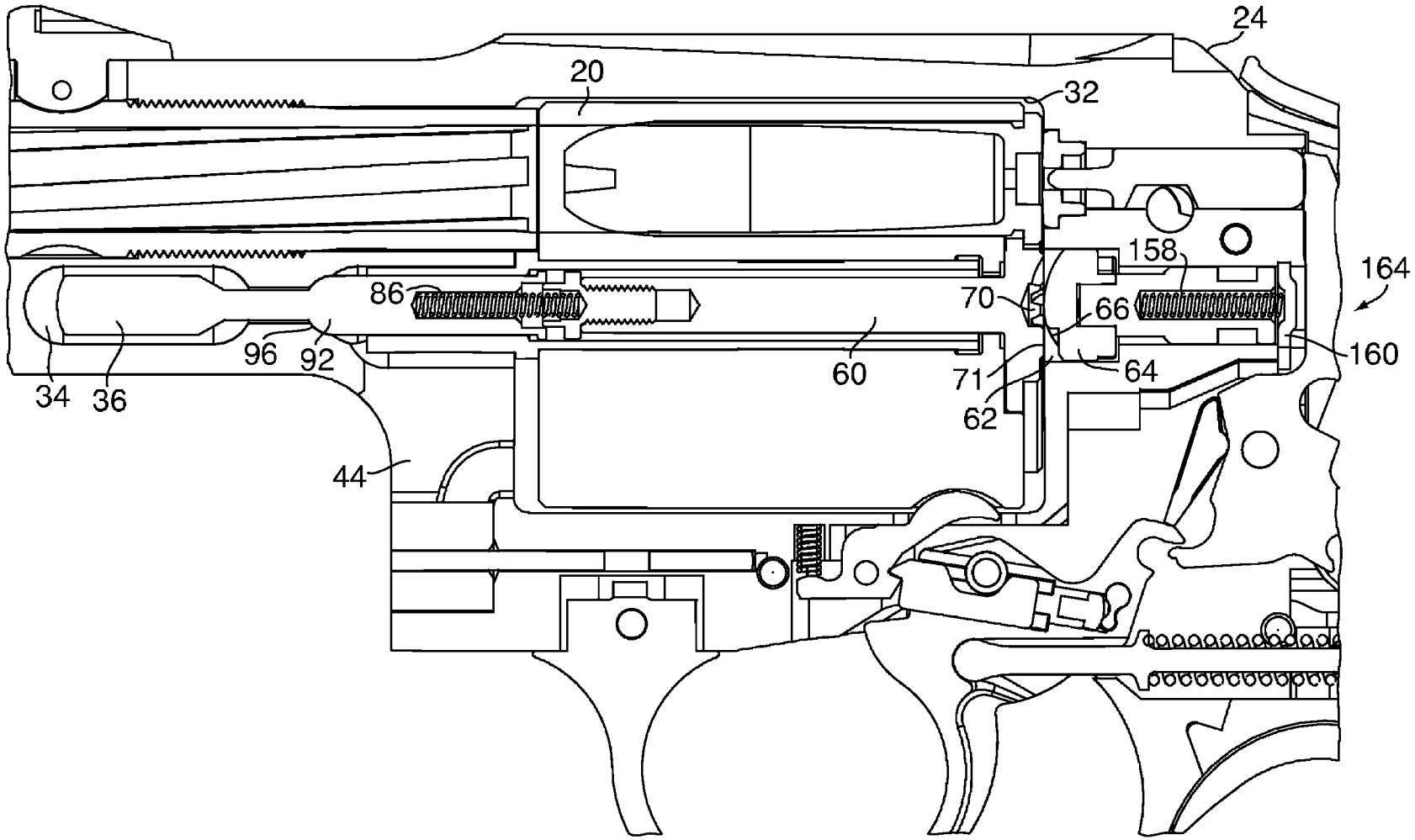
FIG. 25 is a side view of a cross section of the revolver according to the embodiment of FIG. 1.

According to an embodiment of the present invention, a cylinder retaining mechanism 164, such as a yoke lockup mechanism, is provided to retain the cylinder 20 within the rectangular aperture 32, especially subsequent to firing. Referring now to FIG. 25, the cylinder retaining mechanism 164 includes the extractor 60 and the ratchet hub driver 64 in locking engagement. In the cylinder-closed position, the ratchet hub driver 64 is pressed forward by the resistive force of the compressed ratchet drive spring 158. Accordingly, the extractor 60 and the ratchet hub driver 64 are biased into a locking engagement with one another. The locking engagement is enhanced by the complimentary star-shaped configuration of grooves 70 and ridges 66 provided on the extractor 60 and ratchet hub driver 64, respectively, ensuring proper alignment and improving tolerance characteristics.

According to another embodiment of the present invention, the cylinder retaining mechanism 164 includes the rear taper 92 and concave recess 96 in locking engagement. In the cylinder-closed position, the rear taper 92 is pressed forward into engagement with the concave recess 96 under the resistive force of the compressed extractor rod spring 86. The engagement acts to prevent the cylinder 20 from rotating out of the rectangular aperture 32.

According to another embodiment of the present invention, the cylinder retaining mechanism 164 is provided to facilitate and hasten retention of the cylinder 20 in the rectangular aperture 32. As an initial matter, the cylinder retaining mechanism 164, which includes the extractor 60 and the locking bolt 36 assembly (see FIGS. 7-11), the ratchet hub driver 53 and the hub drive center pin 144 assembly (see FIGS. 22-23), and the yoke 44 and the cylinder 20 assembly, is designed to ensure the close fit of the cylinder 20 within the various elements contained in the upper frame portion 24, particularly regarding the barrel-cylinder gap. In addition, the cylinder retaining mechanism 164 promotes the closing of the cylinder 20.

To exemplify the cylinder-closing process, if the cylinder 20 is in the cylinder-open position (e.g., to replenish the ammunition cartridges 106 in the chambers 104) and it is desired to have the cylinder 20 in the cylinder-closed position, the cylinder 20 need only be pressed along the pivot path of the yoke 44 and into the rectangular aperture 32. As the cylinder 20 approaches the cylinder-closed position, the rear taper 92 of the locking bolt 36 slides along the rounded grooves 94 of the narrow section of the locking bolt recess 34 and is forced rearward into a secured position, which causes the extractor 60 to press against the breach face 56 and the extractor rod spring 86 to compress. As the cylinder 20 draws still closer to the cylinder-closed position, the extractor 60 and ratchet hub driver 64 make contact and the ratchet hub driver 64 is forced away from the extractor 60 by said contact, which causes the ratchet drive spring 158 to compress. Eventually, the rear taper 92 crosses the threshold of the concave groove 96 at substantially the same time that a groove 70 of the star-shaped configuration of the extractor 60 comes into contact with a vertex of the ridges 66 of the star-shaped configuration of the ratchet hub driver 64. In response, the extractor 60 and ratchet hub driver 64 snap into engagement with one another as the stored energy of the compressed extractor rod spring 86 and ratchet drive spring 158 is partially released. At which point, the cylinder 20 is in the cylinder-closed position.

It should be appreciated that the cylinder retaining mechanism 164 of the present invention includes four coupled engagements: the rear taper 92 and concave recess 96 engagement; the extractor 60 and ratchet hub drive 64 engagement; the ridge 66 and groove 70 engagement; and the annular ring 71 and the annular opening 62 engagement. Each engagement acts to retain the cylinder 20 in the rectangular aperture and each of which readily aligns and snaps into the respective cylinder-closed positions.

It should also be appreciated that in any of the above-discussed cylinder retaining mechanism, the amount of force applied required to move the cylinder to the cylinder-closed position is substantially related to the characteristics of the springs 86, 158 and the geometry and placement of the rounded grooves 96 and rear taper 92, the extractor 60 and the ratchet hub driver 64, the star-shaped grooves 70 and ridges 66 as well as the annular ring 71 and annular opening 62.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

Figure 26:
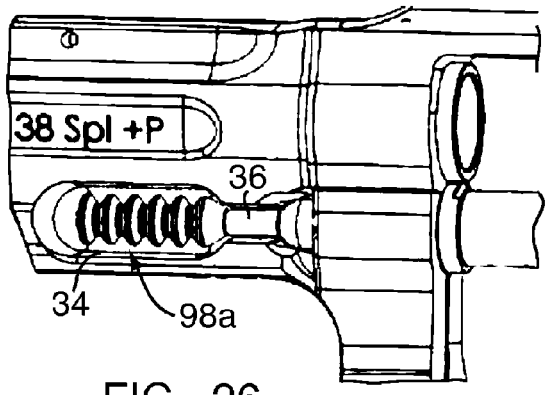
FIG. 26 is a perspective view of a front end of the firearm including the locking bolt recess and a locking bolt with a knob according to another embodiment of the present invention.

For example, referring now to FIG. 26, according to another embodiment of the present invention, the firearm 10 defines the locking bolt recess 34 that is provided with the locking bolt 36 that has a removable, honey spoon-shaped knob 98*a*. The honey spoon-shaped knob 98*a* promotes traction and manipulation by the user while reducing the potential for debris to be trapped behind the locking bolt 36.

What is claimed is:

1. A firearm having a cylinder retaining mechanism comprising:

a frame defining an aperture having a breach face and a locking bolt recess disposed on a side of the aperture opposite from the breach face, wherein the locking bolt recess comprises a narrow section with a concave recess;

a cylinder mounted in the aperture and defining a bore; and a locking bolt mounted in the bore and fitted to be received in the concave recess;

wherein the cylinder is retained in the aperture when the locking bolt is received in the concave recess.

2. The firearm of claim 1, wherein the narrow section of the locking bolt recess further comprises rounded grooves that abut the concave recess, extend substantially laterally outward therefrom and are configured to slideably receive the locking bolt.

3. The firearm of claim 1, wherein the locking bolt has a remote end including a knob, a conical front taper abutting the knob, a narrow rod portion abutting the front taper portion and a conical rear taper abutting the rod portion and fitted to engage the concave recess.

4. The firearm of claim 3, wherein the frame further defines an annular opening in the breach face of the aperture; and the firearm further comprises:

an extractor mounted in the rectangular opening and having an annular ring fitted to be inserted in the annular opening.

5. The firearm of claim 4, wherein the annular opening and the locking bolt recess are coaxial.

6. The firearm of claim 1, wherein the frame further defines an annular opening in the breach face of the aperture; and the firearm further comprises:

an extractor mounted in the bore and having an annular ring fitted to be inserted in the annular opening.

7. The firearm of claim 6, wherein the annular opening and the locking bolt recess are coaxial.

8. The firearm of claim 6, wherein the extractor reciprocally engages the locking bolt within the bore.

9. The firearm of claim 8, further comprising:

an extractor rod spring disposed between the extractor and the locking bolt for spring-biasing the extractor and the locking bolt away from one another.

10. The firearm of claim 9, wherein the annular ring of the extractor is spring-biased into the annular opening of the breach face by the extractor rod spring; and wherein the locking bolt is spring-biased into the concave recess of the narrow section of the frame by the extractor rod spring.

11. The firearm of claim 9, wherein a remote end of the extractor from the annular ring defines a cylindrical recess;

wherein a remote end of the locking bolt from the locking bolt recess defines an opposing recess; and wherein the extractor rod spring has a first end mounted in the cylindrical recess of the extractor and a second end mounted in the opposing recess of the locking bolt.

12. A firearm having a cylinder retaining mechanism comprising:

a frame defining an aperture and an annular opening in a breach face thereof;

a cylinder pivotally mounted in the aperture and defining a bore; and an extractor mounted in the bore and having an annular ring fitted to be inserted in the annular opening;

wherein the cylinder is retained in the aperture when the annular ring is inserted in the annular opening.

13. The firearm of claim 12, wherein the frame further defines a locking bolt recess disposed on an opposing side of the aperture from the breach face; and wherein the locking bolt recess has a narrow section with a concave recess; and the firearm further comprising:

a locking bolt reciprocally engaged to the extractor and having narrow rod portion defining a conical rear taper that is configured to releasably mount to the concave recess.

14. The firearm of claim 13, wherein a remote end of the extractor from the annular ring defines a cylindrical recess;

wherein a remote end of the locking bolt from the rod portion defines an opposing recess; and the firearm further comprising:

an extractor rod spring having one end mounted in the cylindrical recess and a second end mounted in the opposing recess for spring-biasing the annular ring into the annular opening and the rear taper into the concave recess.

15. A firearm having a cylinder rotating mechanism, the firearm comprising:

a frame defining an aperture;

a cylinder rotatably mounted in the aperture and having a bore;

an extractor mounted coaxially in the bore, wherein the extractor is rotationally fixed to the cylinder;

a ratchet hub driver mounted coaxially with and engaged to the extractor and having annular lobed ridges;

a hand having an end that abuts and reciprocally engages the annular lobed ridges of the ratchet hub driver; and a trigger connected to a distal end of the hand;

whereby actuation of the trigger causes the hand to engage the annular lobed ridges of the ratchet hub driver, which rotates the ratchet hub driver, the extractor and the cylinder.

16. The firearm of claim 15, wherein the extractor has a star-shaped configuration of grooves;

wherein the ratchet hub driver has a star-shaped configuration of ridges fitted to engage the star-shaped configuration of grooves; and wherein the engagement of the ridges to the grooves rotationally fixes the ratchet hub driver to the extractor.

17. The firearm of claim 15, wherein the bore is arcuate-shaped and disposed at an axial center of the cylinder;

wherein the extractor has a shaft portion with a flattened surface fitted to engage the bore; and wherein the engagement of the flattened surface to the bore rotationally fixes the extractor to the cylinder.

18. The firearm of claim 15, wherein the ratchet hub driver further comprises a uniform radius cylindrical surface; and wherein the annular lobed ridges are disposed at intervals around the uniform radius cylindrical surface.

19. The firearm of claim 18, wherein the cylinder further comprises a plurality of chambers for receiving ammunition cartridges; and wherein the number of the annular lobed ridges of the ratchet hub driver is the same as the number of the plurality of chambers of the cylinder.

20. The firearm of claim 15, wherein the cylinder further comprises a plurality of outer recesses; and the firearm further comprises:

a cylinder stop connected to the trigger and releasably engaging one of the plurality of outer recesses for preventing the cylinder from rotating about the axis of the cylinder.

* * * * *